US005653188A

United States Patent [19]

Molin

[11] Patent Number: 5,653,188

[45] Date of Patent: Aug. 5, 1997

[54] SEMI SUBMERSIBLE PLATFORM WITH POROUS PONTOONS

[75] Inventor: Bernard Molin, Vaucresson, France

[73] Assignee: Institut Francais du Petrole, Rueil Malmaison, France

[21] Appl. No.: 534,464

[22] Filed: Sep. 27, 1995

Related U.S. Application Data

[63] Continuation of Ser. No. 916,827, Oct. 9, 1992, abandoned.

[30] Foreign Application Priority Data

Dec. 13, 1990 [FR] France ..... 90 15749

[51] Int. Cl.[6] ..... B63B 39/10

[52] U.S. Cl. ..... 114/266; 114/265

[58] Field of Search ..... 114/61, 265, 264, 114/125, 266

[56] References Cited

U.S. PATENT DOCUMENTS 3,817,199 6/1974 Schirtzinger ..... 114/265

3,830,178 8/1974 Lang ..... 114/265

FOREIGN PATENT DOCUMENTS 1147635 3/1985 U.S.S.R. ..... 114/266

2008515 6/1979 United Kingdom ..... 114/266

*Primary Examiner*—Thomas J. Brahan

*Attorney, Agent, or Firm*—Antonelli, Terry, Stout & Kraus, LLP

[57] ABSTRACT

Semi-submersible platform comprised particularly of semi-immersed columns and totally immersed elongate elements or pontoons (4) having a substantially horizontal axis, at least some of them having porous walls, the porosity being obtained by a large number of small holes in said walls. The porosity degree, in other words the ratio between the total surface of the holes and the total surface of the walls is preferably at the most equal to 30%.

5 Claims, 3 Drawing Sheets

SEMI SUBMERSIBLE PLATFORM WITH POROUS PONTOONS

Figure 1:
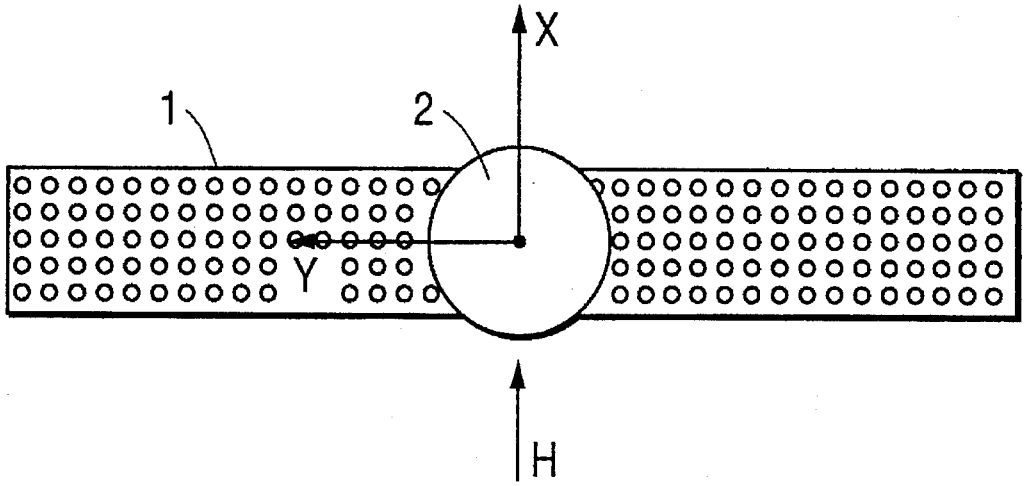

This is a continuation of application Ser. No. 07/916,827, filed Oct. 9, 1992 now abandoned.

The present invention relates to a semi-submersible platform which can for example be used for offshore production.

This type of structure is normally formed by partially submerged elongate members with a vertical axis (or columns), and totally submerged elongate members, with a horizontal axis, known as pontoons. These members, which are variable in number, can be arranged together in different ways so as to form the framework of a semi-submersible platform.

The structures thus formed generally support a deck on which is secured equipment specific to the function for which the platform is intended.

Such structures are for example disclosed by the documents U.S. Pat. No. 4,112,864, U.S. Pat. No. 3,949,693 or again U.S. Pat No. 3,967,572.

In order to maintain this type of platform above a precise fixed point on the sea bed, several positioning systems are used. Flexible cables can connect anchoring points on the sea bed to points on the platform. There are also systems known as "dynamic positioning" systems consisting of propulsion means fixed to the platform and designed to return it to its original position as soon as any drift is ascertained.

In the case of petroleum production, one or more flexible pipes or "risers" connect the wells to the platform and provide the production function itself.

Moreover, semi-submersible structures have to confront extremely difficult sea states. In the North Sea, for example, "crest to trough" gradients of the order of 30 meters are to be expected. Such structures are therefore highly stressed and must in particular have a high structural strength.

The sizing of the various members making up these installations is therefore particularly tricky and must comply with a certain number of static and dynamic criteria.

A static-type criterion concerns for example the hydrostatic stability stress which mainly determines the cross section and spacing of the columns. The columns thus sized generally have a large cross section.

The dynamic criteria, related in particular to the swell periods, mean that the natural periods of the structure with respect to roll, pitch and heave should be situated well above the said swell periods. Another dynamic criterion relates to the balancing period, that is to say the period at which a complete counterbalancing of the vertical forces acting on the columns and pontoons is obtained. By choosing the dimensions of the columns and pontoons in an appropriate manner, a given balancing period is obtained which should be an upper limit of the swell periods normally encountered in a particular geographical area. For example, in the North Sea, the sizing of semi-submersible platforms has to be such that their balancing period is between 18 and 20 seconds.

In order to meet these criteria, the pontoons on semi-submersible platforms have to be bulky and normally represent 70 to 80% of the total submerged volume.

The semi-submersible platforms produced up until now in accordance in particular with the criteria set out above are therefore fairly large, whence problems with completion times and costs, which may prove burdensome in certain cases.

The aim of the present invention is to remedy in particular these size problems, by proposing a semi-submersible structure of reduced dimensions compared with conventional structures, and which of course also meet the sizing criteria set out above. The present invention concerns a semi-submersible platform of the type defined at the beginning of this description and on which, in accordance with the invention, at least some of the pontoons have porous walls.

The porosity is notably achieved by means of a large number of openings in the walls; the openings can be perforations of any shape, slots, etc.

The porosity ratio, ie the ratio of the area of the openings to the total area of the walls of each pontoon, is preferably between 10 and 30%.

The present invention will have particular application as a production platform or "support".

Figure 2:
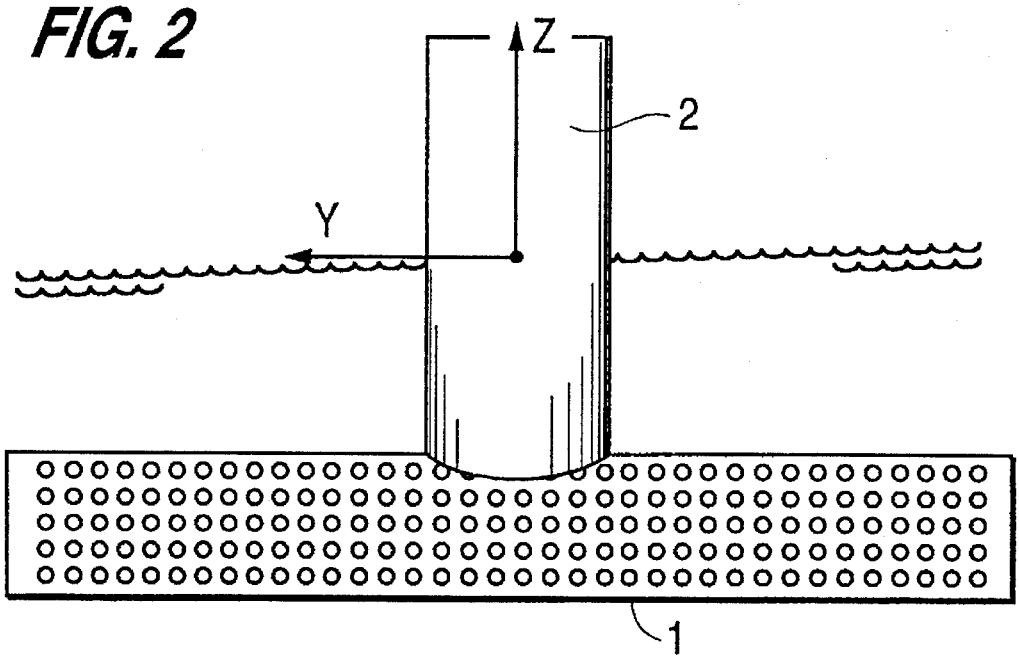
Figure 3:
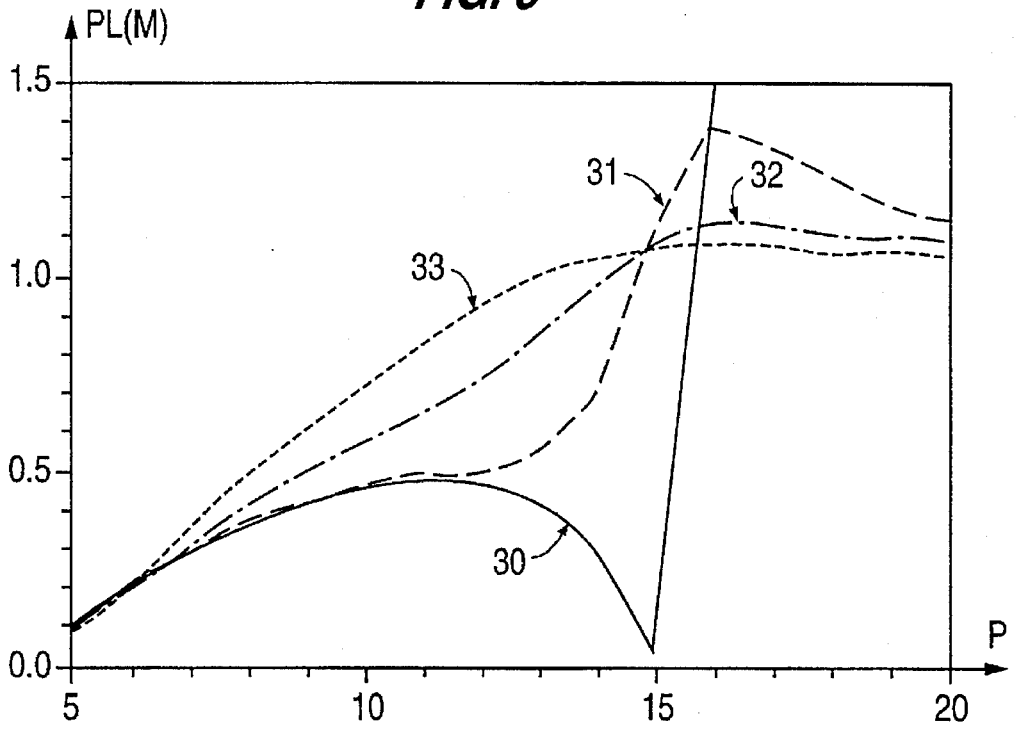
Figure 4:
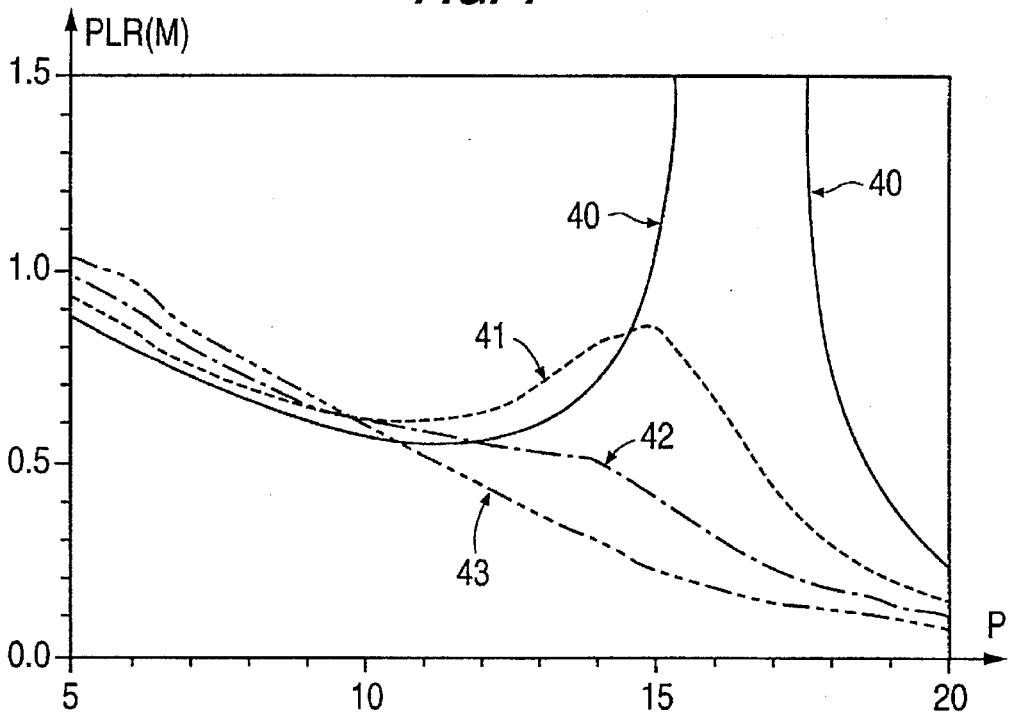
Figure 5:
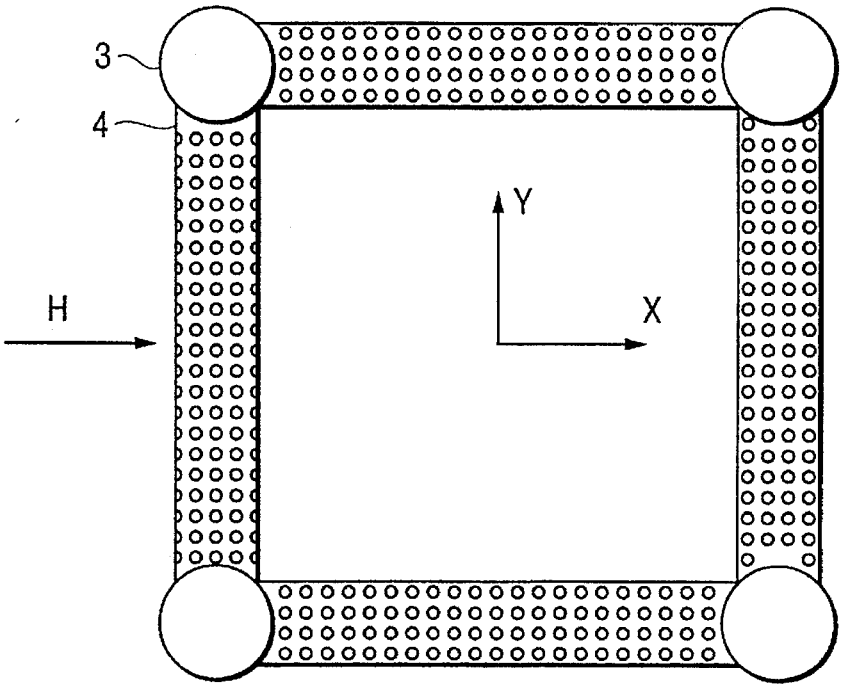
Figure 6:
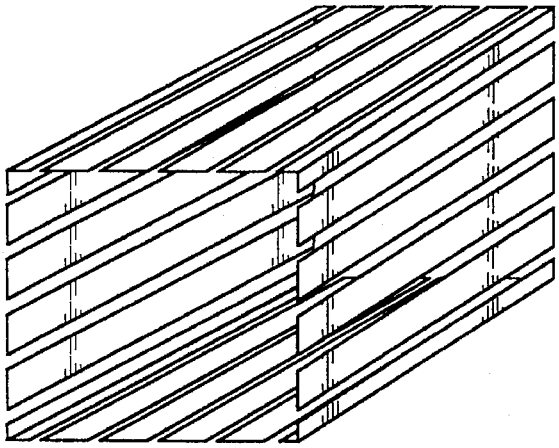
Figure 7:
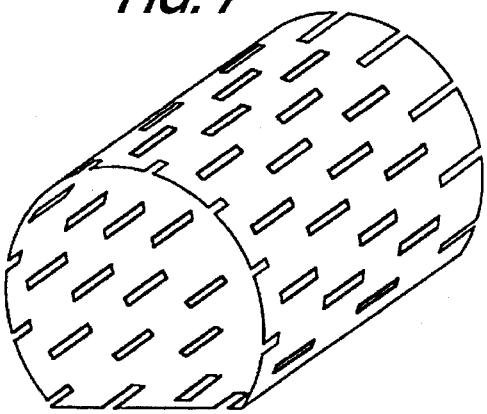

Other characteristics and advantages of the present invention will be clearer from a reading of the following description, given by way of illustration and non-limitatively, with reference to the accompanying drawings in which:

FIG. 1 is a plan view of a model used for showing the features of a porous pontoon, FIG. 2 is a front elevation view of the model of FIG. 1, FIG. 3 shows the curves of the heave transfer functions obtained for the model shown in FIGS. 1 and 2, FIG. 4 shows the relative heave transfer functions obtained for the model given by FIGS. 1 and 2, FIG. 5 is a plan view of an embodiment of the invention, and FIGS. 6 and 7 each show in perspective view an arrangement of a porous pontoon according to the invention.

FIGS. 1 and 2 show a model used to display certain physical features of a structure provided with a porous member. The model taken as an example in this case is, however, entirely representative of an actual semi-submersible platform structure particularly with regard to its hydrodynamic behaviour.

The model, which is almost completely submerged, consists of a first cylinder 1 with a horizontal axis Y, which is porous, ie which has in it holes, slots or other small openings.

The second cylinder 2 with a vertical axis Z is connected to the first, approximately at its middle. The diameter of the second cylinder 2 is somewhat greater than that of the first.

A study was made, from this model, on the vertical translational movement referred to as "heave", due to the action of the swell.

The horizontal translational movement, in the direction of propagation of the swell and known as "surge", was also studied.

The response of a floating structure, notably vis-a-vis heave, is in fact very significant for its sizing and for the evaluation of its performance.

Advantageously, the porous pontoons according to the invention are provided with openings on each of their walls. Thus, with a porous pontoon according to the invention, head losses proportional to the square of the relative velocity of the flow passing over it are created, whence a very high damping effect, which considerably limits the phenomena of resonance.

FIG. 3 shows particularly well the phenomenon of damping created by the porous pontoons. In fact, the curve 30 in solid lines represents the heave transfer function of a watertight pontoon. Resonance can clearly be seen, for swell periods of approximately 16 or 17 seconds.

This resonance is advantageously limited or even eliminated if porous pontoons are considered, the behaviour of which is shown by the dotted line curves 31 to 33 in FIG. 3. These three curves correspond to the response of pontoons which have respectively porosities of 10, 20 and 30%. A porosity of 30% completely eliminates the phenomenon of resonance.

It is clear from the above that, on a hydrodynamic level, the porosity ratio of the pontoons is a preponderant parameter. The shape of the small openings, on the other hand, does not seem to be significant, nor does the shape of the cross section of the pontoons.

Unlike traditional semi-submersible platforms and advantageously, the cross section of the porous pontoons according to the invention can be less than that of the columns.

Moreover, compared with a conventional structure, that is to say one having pontoons with solid walls, the manufacturing cost of the porous pontoons themselves can be appreciably reduced since the porous pontoons no longer have to withstand hydrostatic pressure.

In addition, the porous pontoons, which lose their buoyancy function, nevertheless continue to participate in the structural stiffness of the whole, whilst fulfilling a significant damping role.

The damping afforded by the porous pontoons in fact makes it possible to limit or even eliminate the resonant frequencies of the structure with respect to heave, that is to say with respect to the vertical translational movements, as is clear from FIG. 3. Moreover, this damping acts on the horizontal movements of the structure.

The damping created by the porous pontoons tends in fact to make the low frequency oscillations in the horizontal plane disappear.

This characteristic therefore makes it possible to associate a less expensive anchoring with the platforms according to the invention.

In addition, studies have revealed that, as is shown in FIG. 4, the relative heave, that is to say the relative vertical translational movement of the floating structure with respect to the free surface, notably at high swell periods (periods greater than 12 or 13 seconds), decreases very appreciably when solid wall pontoons (curve 40) are replaced with pontoons with a porosity of respectively 10, 20 and 30% (curves 41, 42, 43).

This characteristic makes it possible to decrease the height of the deck, that is to say the distance between the above-water platform and the water level. The gain in height thus obtained is of the order of 50% or more.

The platforms provided with porous pontoons are therefore of reduced dimensions compared with conventional platforms:

with regard to the cross section of the pontoons, and with regard to the height of the deck.

Moreover, a platform according to the invention allows substantial gains with regard to the anchoring, and more specifically with regard to the sizing of the anchoring lines and transfer columns or flexible risers.

One example of an embodiment of a semi-submersible platform according to the invention is given in FIG. 5. According to this embodiment, four columns 3 are disposed at the four corners of a square, each side of which is formed by a completely submerged porous pontoon 4.

Any type of supporting plate or member can be supported, out of the water, by this basic structure.

It can also be envisaged, without departing from the scope of the invention, that a structure provided with both porous pontoons and watertight pontoons could be designed.

The anchoring of such structures can be achieved in any manner known per se.

Moreover, as has already been stated, the cross section of the porous pontoons can be square, as shown in FIG. 7, or again circular as shown in FIG. 8.

Other types of cross section can be envisaged, the most easily achievable example, however, being the one with cross sections which are most usually used conventionally, namely the cross section consisting of a rectangle with bevelled corners.

Preferably, but not limitatively, the present invention will be used in particular in the offshore domain, for small production supports with flexible risers.

Naturally, the expert will be in a position to imagine, from the description which has just been given by way of illustration and in no way limitatively, various variants and modifications which do not depart from the scope of the invention.

I claim:

1. Semi-submersible offshore platform comprising a plurality of semi-submerged columns and horizontally extending pontoons being totally immersed, wherein at least some of said pontoons are porous pontoons, said porous pontoons having a plurality of a small openings provided through all walls of said porous pontoons, wherein said porous pontoons have no buoyancy function and said columns have solid walls rendering said columns watertight.

2. Semi-submersible platform according to claim 1, wherein a porosity ratio of a total area of the openings to a total area of the walls of the porous pontoons is equal to or less than 30%.

3. Semi-submersible platform according to claim 2, wherein said porosity ratio is between 10 to 30%.

4. Semi-submersible platform according to claim 1, wherein the small openings are fashioned as slots.

5. Semi-submersible platform according to claim 1, comprising four columns and four pontoons, with at least two of said pontoons being porous pontoons.

* * * * *